United States Patent [19]

Ide et al.

[11] Patent Number: 4,686,500

[45] Date of Patent: Aug. 11, 1987

[54] ELECTROMAGNETIC RELAY

[75] Inventors: Tatsumi Ide; Masayuki Morimoto; Kei Chiba, all of Tokyo, Japan

[73] Assignee: NEC Corporation, Japan

[21] Appl. No.: 824,131

[22] Filed: Jan. 30, 1986

[30] Foreign Application Priority Data

Jan. 31, 1985 [JP] Japan ..... 60-17364
Jul. 5, 1985 [JP] Japan ..... 60-148643

[51] Int. Cl.[4] ..... H01H 67/02
[52] U.S. Cl. ..... 335/128; 335/129; 335/135
[58] Field of Search ..... 335/107, 97, 127, 128, 335/129, 135

[56] References Cited

U.S. PATENT DOCUMENTS

| | | | |
|---|---|---|---|
| 4,267,540 | 5/1981 | Iketani | 335/128 |
| 4,429,292 | 1/1984 | Schedele | 335/128 |
| 4,535,311 | 8/1985 | Okihura et al. | 335/124 |
| 4,571,567 | 2/1986 | Nestlen et al. | 335/128 |

*Primary Examiner*—E. A. Goldberg
*Assistant Examiner*—Lincoln Donovan
*Attorney, Agent, or Firm*—Laff, Whitesel, Conte & Saret

[57] ABSTRACT

A miniature relay switches a very large current without causing a deterioration of nearby insulation. This is done by providing relatively large clearance spaces in the areas where particles eroding from the contacts might be deposited. Also, housing walls separate the contacts from these areas of particle deposition. Without this clearance space or walls, the deposited particles might cause a short circuit. The invention also provides many structural details which enables the miniature construction.

11 Claims, 15 Drawing Figures

ELECTROMAGNETIC RELAY

BACKGROUND OF THE INVENTION

1. Field of the Invention

This invention relates to an electromagnetic relay (EM relay), and, more particularly, to an EM relay suited for performing the large current-controlled switching operation.

2. Description of the Prior Art

Recent remarkable developments of integration techniques has greatly contributed to achieving a simplified structure of communication systems, control devices and home electrical appliances. This trend is similarly observed in automobiles having mechanically movable mechanisms controlled by electronic circuits.

Those systems, devices, appliances and the power supply circuits therefor are generally equipped with switching elements for large current-switching operations of from several to several tens of amperes. Almost all of the semiconductor switching elements currently available are, however, incapable of such switching operation with a large current, and are susceptible to failures by the application of an abnormal voltage and current caused by lightning bolts or current mixture. An EM relay is, therefore, indispensable to a mechanical switching element in order to effect the switching operation with high reliability under a large current application. However, the EM relay provided with mechanical switching contacts and an electromagnetic driving mechanism for driving such contacts is inevitably larger in size than a semiconductor switching element. This size becomes an obstacle to the recent trend toward the realization of more compact and lighter devices.

To meet such a trend, an EM relay which is light and small enough to be packaged on the same printed substrate with other electronic circuit components and which is adaptable to the large current-switching operation has been described in U.S. Pat. No. 4,535,311. However, this proposed relay cannot provide sufficient dielectric strength since a coil for exciting a core and lead-wire terminals of stationary contact members with electric contact elements are placed in close proximity.

Moreover, the switching operation at a large current generally tends to cause an arc discharge which, in turn, causes particles to be vaporaized from contact material to be deposited around electric contacts. Since such deposited particles are electrically conductive, they deteriorate the insulation to short-circuit contact circuits as the switching operation of the EM relay is repeated.

SUMMARY OF THE INVENTION

An object of this invention is, therefore, to provide an EM relay free from the above-mentioned disadvantages in the prior art relay and capable of providing high dielectric strength between a coil and stationary contact members.

Another object of this invention is to provide an EM relay with a structure which does not permit deposition of vaporized particles of contact material around electric contacts and therefore is free from insulation deterioration even if the operation is repeated many times.

Still another object of this invention is to provide an EM relay which is easy to assemble for achieving the above objects.

According to one aspect of the invention, an EM relay comprises a first stationary contact member made of an electrically conductive material and including a center portion with a wide plate region. A gripped portion extends above the center portion. A stationary contact portion extends in a substantially perpendicular direction from the upper end of the center portion and which has a first stationary electrical contact. An inserting portion extends in a substantially perpendicular direction from the lower end of the center portion. An L-shaped terminal extends in a substantially perpendicular direction from the lower end of the center portion.

A second stationary contact member is made of electrically conductive material and includes a center portion. A gripped portion extends above the center portion. A stationary contact portion extends in a substantially perpendicular direction from the upper end of the gripped portion and has a second stationary electrical contact. An inserting portion extends in a substantially perpendicular direction from the lower end of the center portion. An L-shaped terminal extends in a substantially perpendicular direction from the lower end of the center portion.

An insulative base member includes a hollow tube portion having a core therein and with a coil wound thereon. A first base is provided on one end of the tube portion and has first and second gripping portions for securing the gripped portions of the first and second stationary contact members, respectively. A second base is provided on the other end of the tube portion substantially in parallel with said first base and having first and second grooves for receiving and securing the inserting portions of the first and second stationary contact members, respectively, and having first and second guide grooves for receiving and guiding the terminals of the first and second stationary contact members, respectively.

A yoke is magnetically connected at one end thereof to one end of the core mounted on the base member. An armature is magnetically connected at one end thereof to the other end of the yoke and opposed to the other end of the core in a manner which makes it able to approach to or recede from the core; a movable contact member, made of mechanically flexible and electrically conductive material, and having a movable arm portion including a movable electrical contact is provided between the first and second stationary contacts to selectively make contact with either the first or the second stationary contact in the movement interlocked with the approaching or receding movement of the armature.

BRIEF DESCRIPTION OF THE DRAWINGS

The above-mentioned objects and features of this invention will be more clearly understood from the following detailed description when taken in conjunction with the accompanying drawings hereinbelow.

In the drawings, the same reference numerals denote the same structural elements.

DESCRIPTION OF THE PREFERRED EMBODIMENTS

Figure 1:
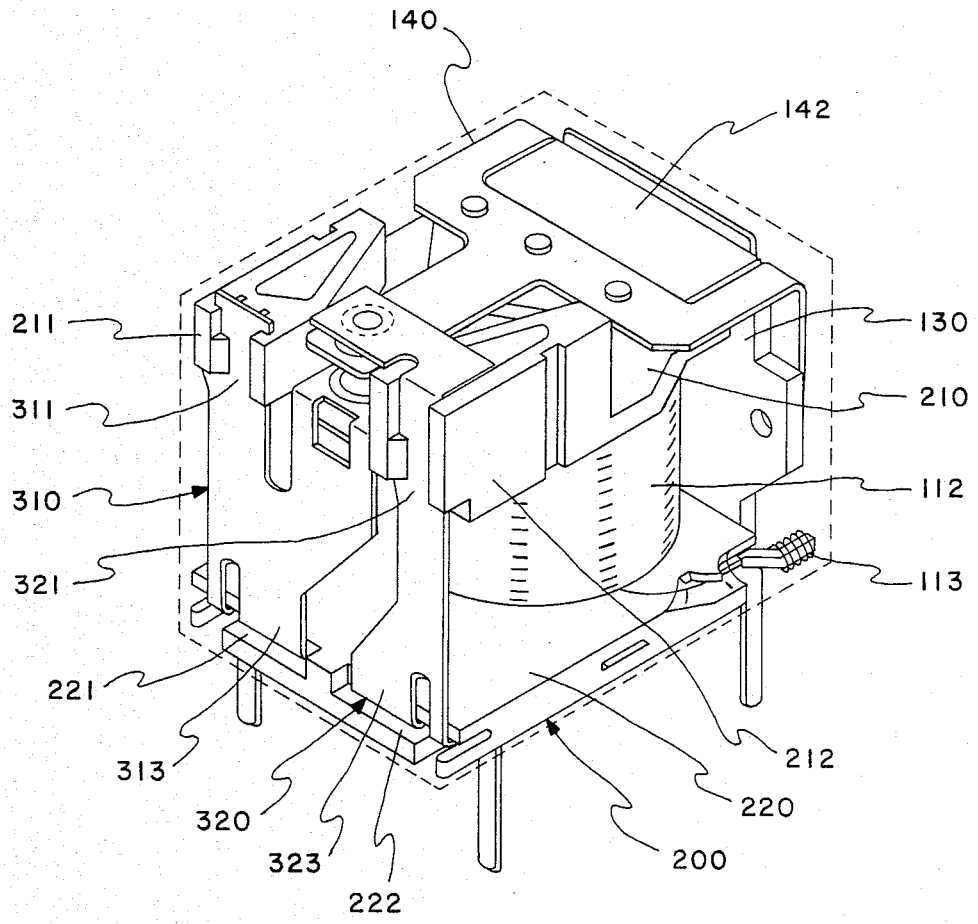
FIG. 1 is a perspective view of the first embodiment of this invention.

Referring to FIG. 1, a first embodiment of the invention comprises an insulative base member 200 having an upper base 210 and a lower base 220, an iron core (not shown) inserted into the base member 200, a coil 112, stationary contact members 310 and 320 supported by the upper base 210 and the lower base 220, a yoke 130, an armature 142, and a movable contact member 140. The coil 112 is mounted between the upper and lower bases 210 and 220 which are substantially parallel to each other. Both ends of the coil 112 are connected to leading terminals 113. The upper base 210 of the base member 200 has gripping portions 211 and 212. The lower base 220 is provided with grooves 221 and 222. The contact member 310 is secured to the base member 200 by inserting a gripped portion 311 and an inserting portion 313 into the gripping portion 211 and into the groove 221, respectively. Similarly, the contact member 320 is fixed to the base member 200 by inserting the gripped portion 321 and the inserting portion 323 into the gripping portion 212 and the groove 222, respectively.

Figure 2:
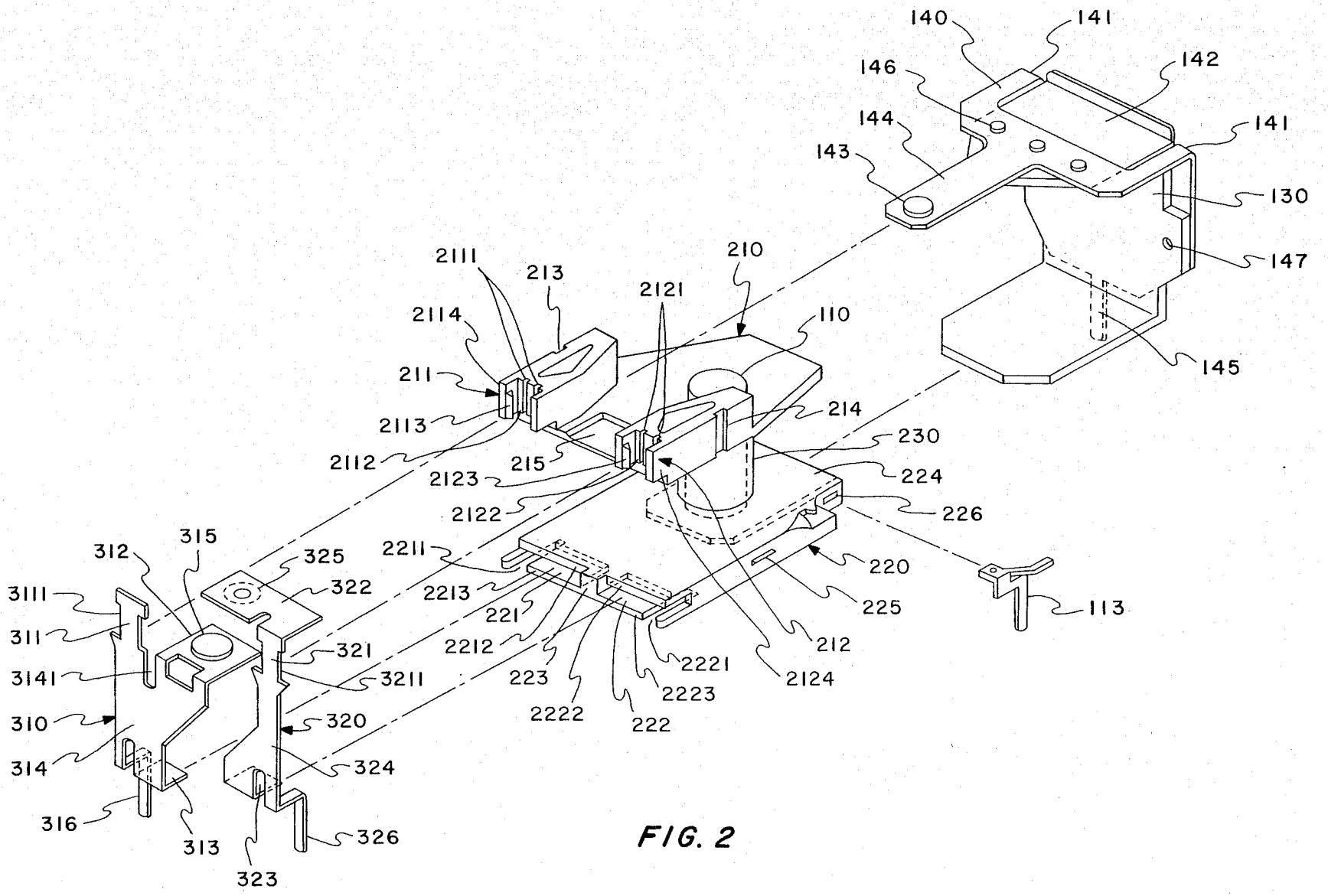
FIG. 2 is an exploded, perspective view of the embodiment of FIG. 1.

Referring to FIGS. 1 and 2, the upper and lower bases 210 and 220 are of the base member 220 made of a resin such as polybuthylene terephthalate and are connected in a substantially parallel relation with respect to each other by a hollow tube portion 230. A core 110 is inserted into the tube portion 230. One end of the coil 112 is wound around the tube portion 230. The upper base 210 has the opposing gripping portions 211 and 212, on both of its sides. The portions 211 and 212 respectively form a wide recess having bottom faces 2112 and 2122 and a pair of side faces 2114 and 2124. These faces 2112 and 2122 have grooves 2111 and 2121, respectively. The side faces 2114 and 2124 have projections 2113 and 2123, respectively. Between the portions 211 and 212 is a thin contact supporting portion 215.

The base 210 has on its opposing sides guide grooves 213 and 214, to guide a cover (not shown). The grooves 2111 and 2121 run in a longitudinal direction on the portions 211 and 212. Grooves 213, 214 have a depth which is sufficient to allow a deformation on the side faces 2114 and 2124 to facilitate an engagement with the gripped portions 311 and 321. One or more of the grooves 2111 and 2121 are provided for each of the bottom faces 2112 and 2122. The projections 2113 and 2123 are spaced apart from the bottom faces 2112 and 2122 by a distance which is substantially identical to the plate thickness of the portions 311 and 321. Faces 2112, 2123 are substantially parallel to the bottom faces 2112 and 2122 on the side faces 2114 and 2124. These projections 2114 and 2124 act as snap-in means for fitting the portions 311 and 321 therein.

The lower base 220 has a thickness which is sufficient to allow a provision of two grooves 221 and 222 on one end thereof and on both sides of the portion 223. Portions 2212 and 2222, lying above the grooves 221 and 222, are formed closer to the tube portion 230 and are shorter than lower portions 2213 and 2223 which contain guide slots 2211 and 2221, respectively.

The stationary contact members 310 and 320 are formed by punching, from an electrically conductive material such as an alloy of Cu-Fe-Sn-P. The contact member 310 has a center portion 314, a stationary contact portion 312 with a stationary contact 315 made of, for instance, AgCdO alloy. A gripped portion 311 has notches 3111, an inserting portion 313, and a leading terminal 316. The center portion 314 has a wide region for radiating heat which is generated on the stationary contact 315. A slit 3141 is provided to widen the surface distance between the contact 315 and the portion 311. The contact portion 312 and the inserting portion 313 are bent in the direction which is substantially perpendicular to the center portion 314. The L-shaped terminal 316 is bent at a normal or right angle and at a position which is identical to the portion 313 on one end of the portion 314. The terminal 316 is bent again at the tip end side at a normal or right angle so as to extend substantially parallel to the portion 314. The notches 3111 has a length substantially identical to the longitudinal length of the gripping portion 211 and has a thickness substantially identical to the thickness of the side face 2114.

The contact member 320 has a gripped portion 321 which is provided with notches 3211 of the shape substantially identical to that of the notches 3111. A stationary contact portion 322 has a stationary contact 325 of, for instance, an AgCdO alloy, an inserting portion 323, a leading terminal 326, and a center portion 324. Those portions 322 and 323 are bent in a direction substantially perpendicular to the center portion 324. The L-shaped terminal 326 is bent at normal angle at a position substantially identical to that of the portion 323 on one end of the portion 324. The terminal 326 is bent again at a normal angle on the tip end side so as to extend substantially parallel to the portion 324.

The contact members 310 and 320 are simultaneously engaged with the base member 200 and are fixed by fitting the portions 311 and 321 into the portions 211 and 212 and by inserting the portions 313 and 323 into the grooves 221 and 222. When assembled, these contact members 310 and 320 are juxtaposed on the same plane while the stationary contacts 315 and 325 are vertically opposed at a prescribed interval. The contact portion 312 is mounted on the supporting portion 215.

Figure 3C:
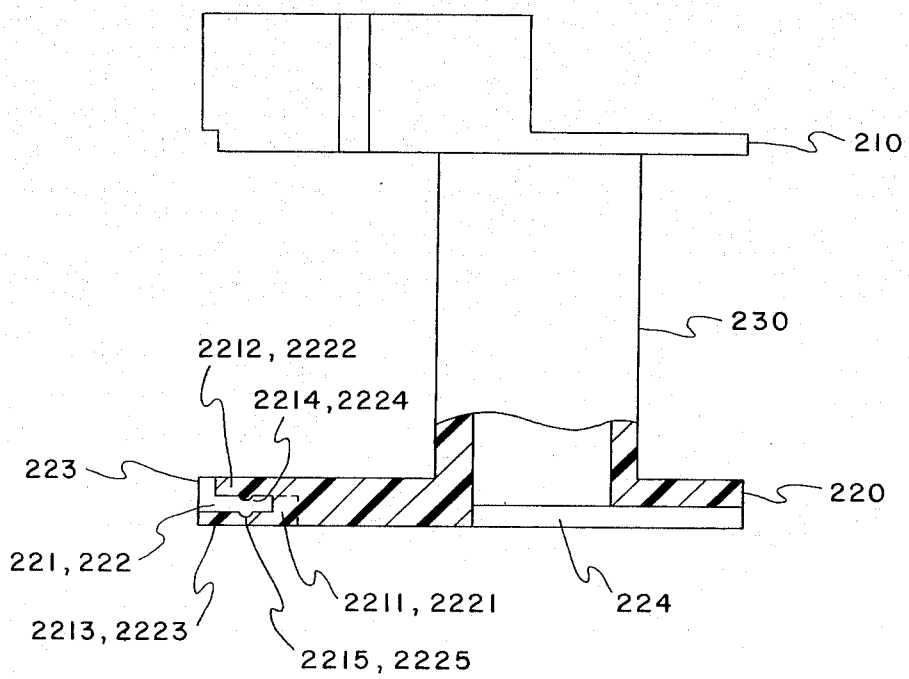
FIG. 3C is a partial cross sectional view for describing a modification to a part of the embodiment shown in FIG. 1.
Figure 3B:
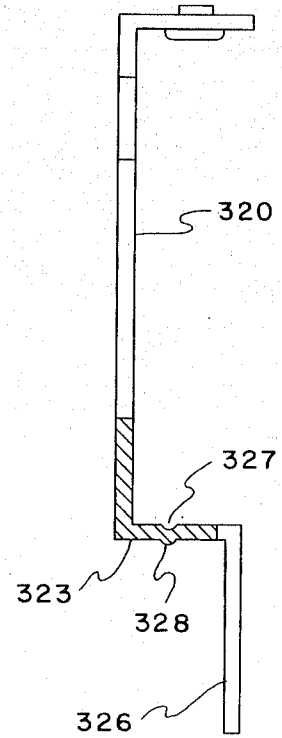
FIGS. 3A and 3B are partial cross sectional views for describing a part of the embodiment of FIG. 1.
Figure 3A:
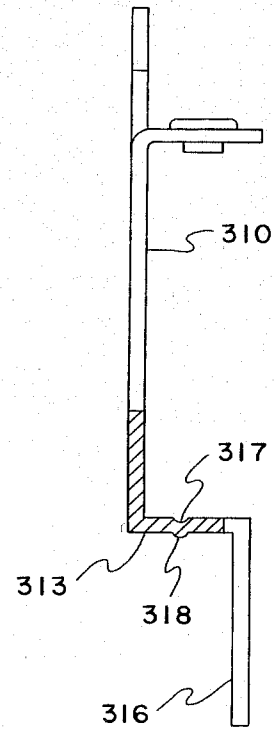

As shown in FIGS. 3A and 3B, the inserting portion 313 of the contact member 310 is provided with a recess 317 and a projection 318. The insert portion 323 of the contact member 320 is provided with a recess 327 and a projection 328. When the portions 313 and 323 are inserted in the grooves 221 and 222 respectively, the projections 318 and 328 abut against the portions 2213 and 2223 under pressure due to the height thereof so as to prevent the portions 313 and 323 from being withdrawn.

Referring to FIG. 3C, the portions 2212 and 2222 may be provided with projections 2214 and 2224. The portions 2213 and 2223 may be provided with recesses 2215 and 2225 respectively within the grooves 221 and 222 of the lower base 220. In such a case, in response to the insertion of the portions 313 and 323 into the grooves 221 and 222, the projections 2214 and 2224, and 318 and 328 become engaged with the recesses 317 and 327, and 2215 and 2225 respectively for firmer engagement.

Figure 3D:
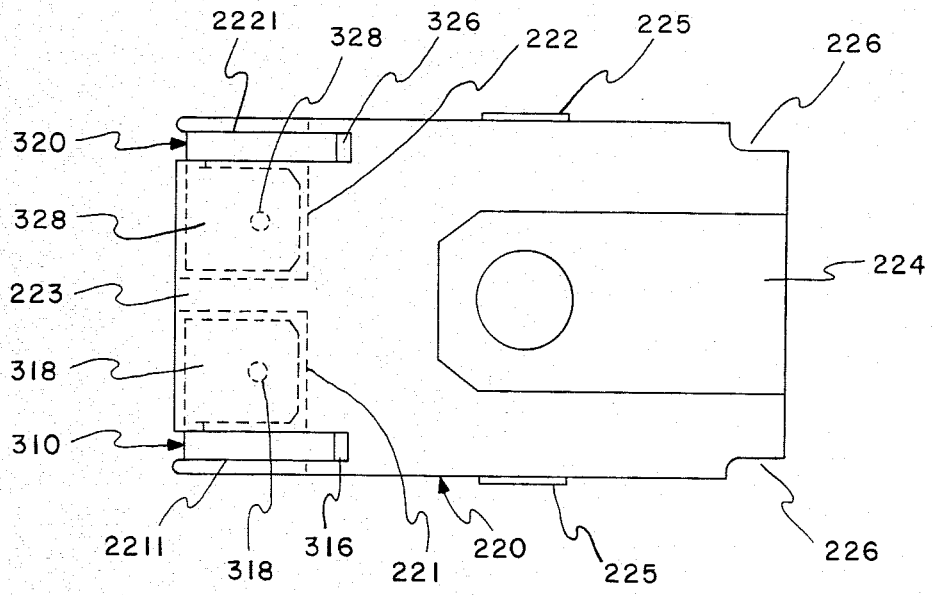
FIG. 3D is a bottom view for describing a part of the embodiment of FIG. 1 in more detail.

Referring to FIG. 3D, the terminals 316 and 326 of the contact members 310 and 320 are respectively inserted into the guide slots 2211 and 2221. In fixing the contact members 310 and 320, the terminals 316 and 326 are inserted first. In turn, this insertion of these terminals 316 and 326 guide the insertion of the portions 313 and 323. The insertion of these plane-like portions 313 and 323 guides the gripped portions 311 and 323 for insertion thereof. As described above, the assembling of the contact members 310 and 320 with the base member 200 can be made smoothly and securely. After assembly, those elements would not become loosened.

Referring back to FIGS. 1 and 2, the assembling method of the base member 200 with the yoke 130, the armature 142, and the movable contact member 140 will now be described in detail. The L-shaped yoke 130 is made of a magnetic material such as pure iron and is assembled within a recess 224 in the lower base 220 to be fixed with the lower end of the core 110. The upper end of the yoke 130 is in contact with one side of the upper base 210.

The armature 142 is made of a magnetic material such as pure iron and is arranged to oppose the upper end of the core 110. Armature 142 is attached by rivets 146 to the contact member 140 in a manner which places one end thereof in contact with the upper end of the yoke 130.

The contact member 140 is made of a flexible and conductive material such as phosphor bronze, and includes a movable arm portion 144 having movable contacts 143 of an AgCdO alloy on both surfaces thereof. Shoulder portions 141, and a leading terminal 145 complete the contact member 140. The contact member 140 is attached to the yoke 130 with rivets 147. The contact member 140 is also bent into the shape of the letter L at the shoulder portions 141 to make the armature 142 and the movable contacts 143 movable with its own elasticity. The contacts 143 is arranged between the stationary contacts 315 and 325. The leading terminals 113 are inserted within setting grooves 226 of the lower base 220 for fixation.

Although not shown in the drawings, a cover has projections which slide on the guide grooves 213 and has 214, and recesses which fits with the projections 225. The cover is guided by the grooves 213 and 214 to be secured by an engagement with the recesses (not shown) with the projections 225. When the core 110 is not excited, by an energization of winding 112 the movable contacts 143 is forced upward in response to the elasticity of the contact member 140, to come into contact with the stationary contact 325. An electric circuit is formed in the path, the terminal 145 the movable contacts 143, the stationary contact 325, the terminal 326. When the coil 112 is energized via the terminals 113 to excite the core 110, the armature 142 is attracted toward the upper end of the core 110. The arm portion 144 moves with the armature movement to be separated from the contact 325 and to come into contact with the contact 315. The electric circuits is then switched to the path which may be traced from the terminal 145, through the movable contacts 143, the stationary contact 315, the terminal 316.

As is clearly shown in FIGS. 1 and 3, the contact members 310 and 320 are firmly secured on the ends of the upper base 210 and the lower base 220. Therefore, the distance from the coil 112 can be extended to attain a greater dielectric strength. Since the terminals 316 and 326 project from the guide slots 2211 and 2221 respectively underneath the lower base 220, the EM relay of the invention can have the same terminal position and arrangement as the prior art relays and yet achieve the greater dielectric strength.

As described above, the first embodiment of the invention achieves an easier assembly as comared to an assembly of the prior art EM relays. Also, the embodiment maintains a greater insulative distance between a coil and stationary contact members. At electric contacts, however, the contact material becomes vaporized and particles scatter by the arc generated when a large current is interrupted. When the number of switching operations increases, such a vaporized of particles become deposited around the contacts. Since these deposited particles are electrically conductive, the insulation will further deteriorate to often cause the short circuit between the movable contact circuit and the stationary contact circuit. The same problem will occur if these particles are directly deposited on the contact members.

Figure 4B:
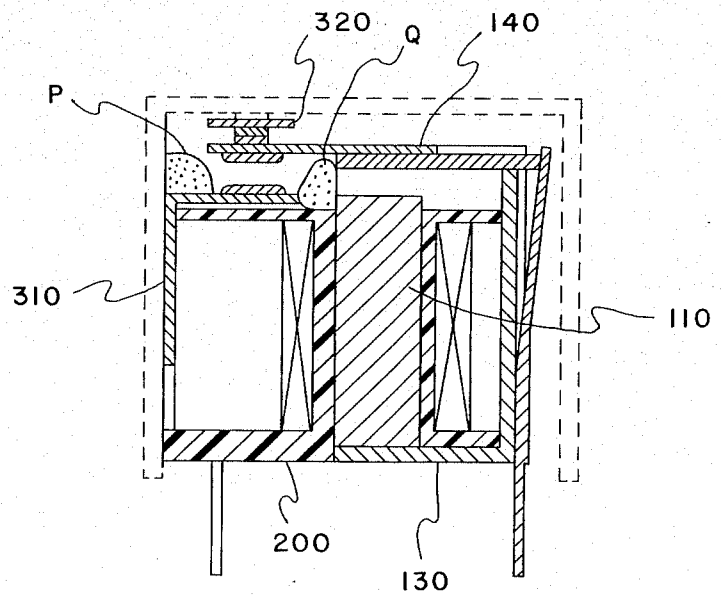
FIGS. 4A and 4B are frontal and side sectional views of the embodiment of FIG. 1 respectively.
Figure 4A:
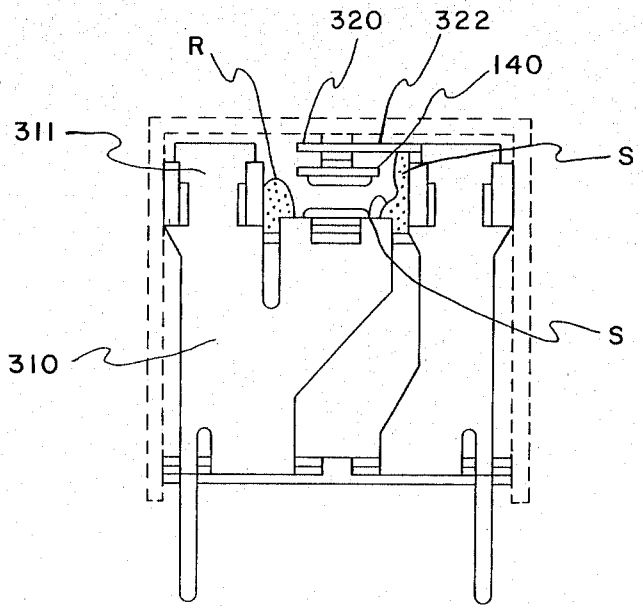

Referring to FIGS. 4A and 4B, the electrically conductive deposits R and P form a short-circuit between the contact member 310 and 140. The deposits S short-circuit between the contact member 310 and 140, and between the contact member 310 and 320. The deposits Q short-circuit between the contact member 310 and the core 110 which is connected to the contact member 140 via the yoke 130, and between the contact member 310 and 140. The insulation becomes deteriorated if the contact material is vaporized and deposited, in large quantities on the upper end of the gripped portion 311 or the contact portion 322.

In view of the above-mentioned problems in the first embodiment, the second embodiment of this invention is improved in the structure thereof for preventing an insulation deterioration, even if the number of operations increases.

Figure 5:
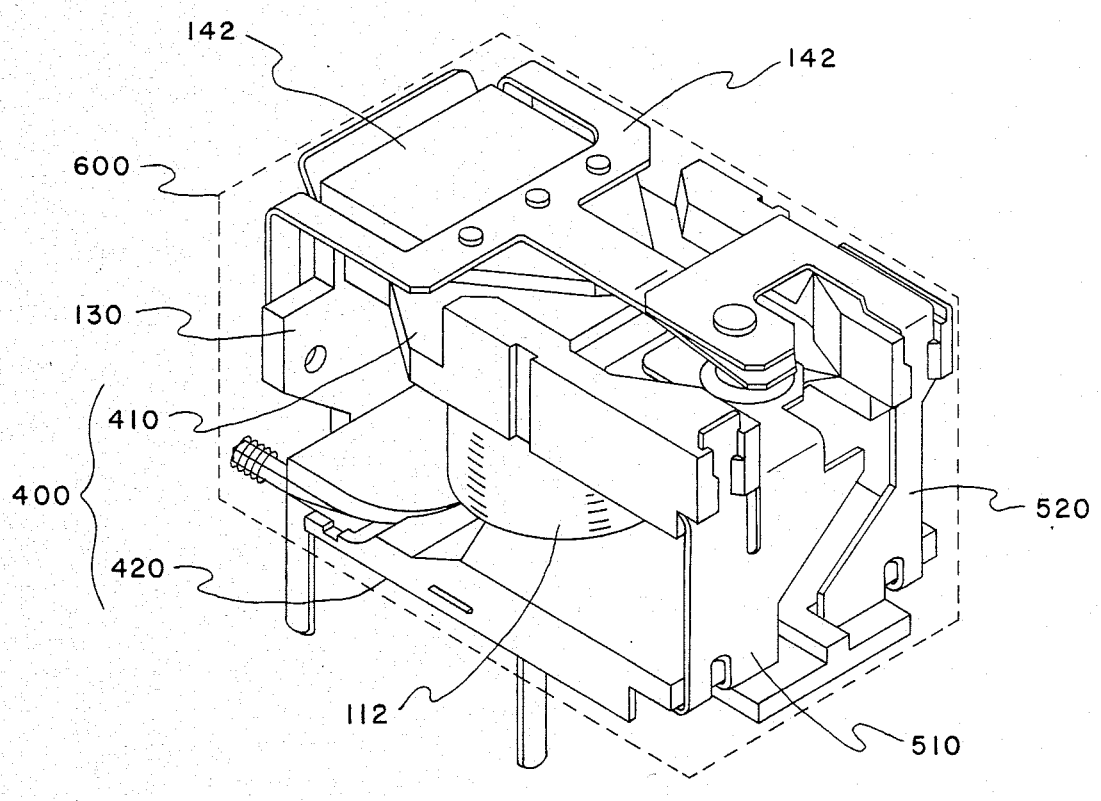
FIG. 5 is a perspective view of the second embodiment of of this invention.

Referring to FIG. 5, the second embodiment of this invention comprises an insulative base member 400 having an upper base 410 and a lower base 420, an iron core (not shown) inserted into said base member 400, a coil 112, stationary contact members 510 and 520 supported by the upper and lower bases 410 and 420, a yoke 130, an armature 142, a movable contact member 140, and a cover 600. The contact members 510 and 520, the base member 400 and the cover 600 are the improved versions of the corresponding members used in the first embodiment, but other structural elements remain the same.

Figure 6B:
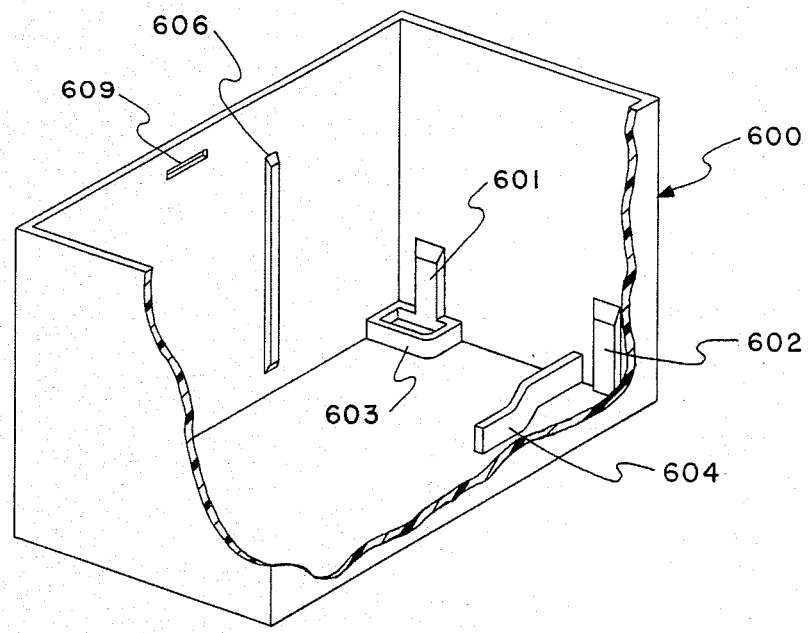
FIG. 6B is a partially cross sectional view for explaining a part of the embodiment shown in FIG. 5 in more detail.
Figure 6A:
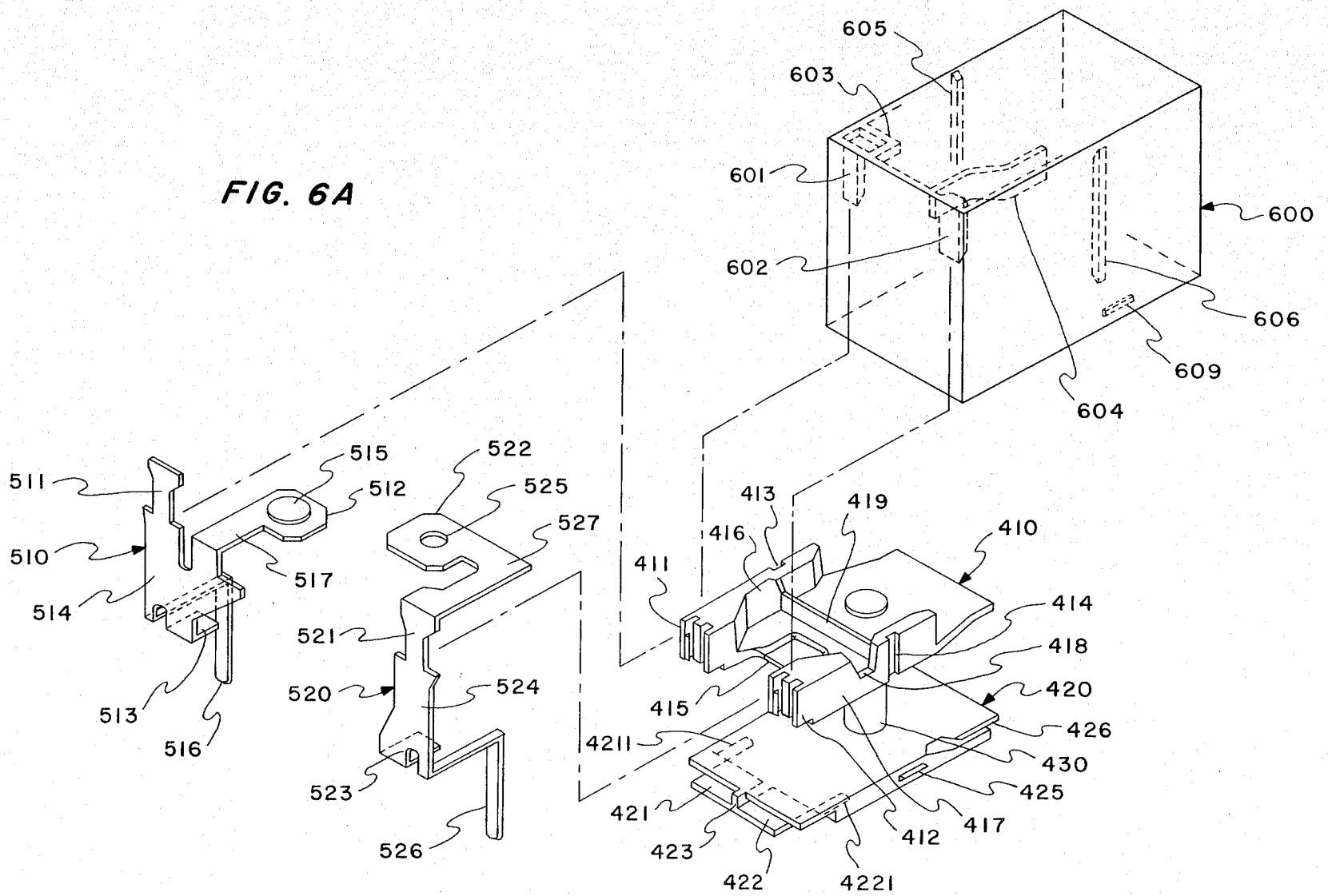
FIG. 6A is an exploded, perspective view of a part of the embodiment of FIG. 5.

Referring to FIGS. 5 and 6A, the base member 400 comprises the upper base 410, the lower base 420 and a hollow tube portion 430. The upper base 410 has gripping portions 411 and 412, side wall portions 416 and 417 extending backward from these portions 411 and 412, and a partition wall 419 connecting these portions 416 and 417.

In order to provide a larger space around electric contacts, the side wall portions 416 and 417 are made as thin as possible, but with enough material to give the necessary strength to the upper base 410 and for the gripping portions 411 and 412, a U-shaped wide notch 415 is provided between the portions 411 and 412. The portions 416 and 417 are provided with guide grooves 413 and 414 respectively for guiding the cover 600 when it is placed from above. The portion 417 is further provided with a notch 418.

The lower base 420 has two grooves 421 and 422 on one side thereof with a portion 423 interposed therebetween. Guide slots 4211 and 4221 extend from the grooves 421 and 422 respectively, to projections 425, for fixing the cover 600, and to grooves 426 for fixing the leading terminals 113.

The contact member 510 has a center portion 514, a gripped portion 511 to be gripped by the portion 411, and an inserting portion 513 to be inserted and retained in the groove 421. A terminal 516 is inserted in the guide slot 4211 to project downwardly from the lower base 420. A stationary contact portion 512 is fixed with a stationary contact 515. An elongated arm portion 517 connects the center portion 514 and the contact portion 512. This contact member 510 differs from the contact member 310 shown in FIG. 2 in that the arm portion 517 is newly provided so as to expand the space interval between the portions 514 and 512. The contact member 520 has a center portion 524, a gripped portion 521 which is to be gripped by the portion 412 and, an inserting portion 523 which is to be inserted and retained in the groove 422. A terminal 526 is inserted in the guide slot 4221 to project downwardly from the lower base 420. A stationary contact portion 522, with a stationary contact 525, and an elongated arm portion 527 formed in the L-shape for connecting the gripped portion 521 and the contact portion 522. This contact member 520 differs from the contact member 320 shown in FIG. 2 in that the arm portion 527 is newly provided.

Referring also to FIGS. 6A and 6B, the cover 600 is made of an insulative resin and has guide projections 601 and 602, partition walls 603 and 604, guide projections 605 and 606, and recesses 609. The shorter guide projections 601 and 602 abut respectively against the gripped portions 511 and 521 of the contact members 510 and 520 to guide the cover 600 when it is placed from above. The longer guide projections 605 and 606 slide respectively in the guide grooves 413 and 414 of the upper base 410 to guide the cover 600, when placed. The base member 400 is engaged with the cover 600 by fitting the projections 425 into the recesses 609.

Figure 7B:
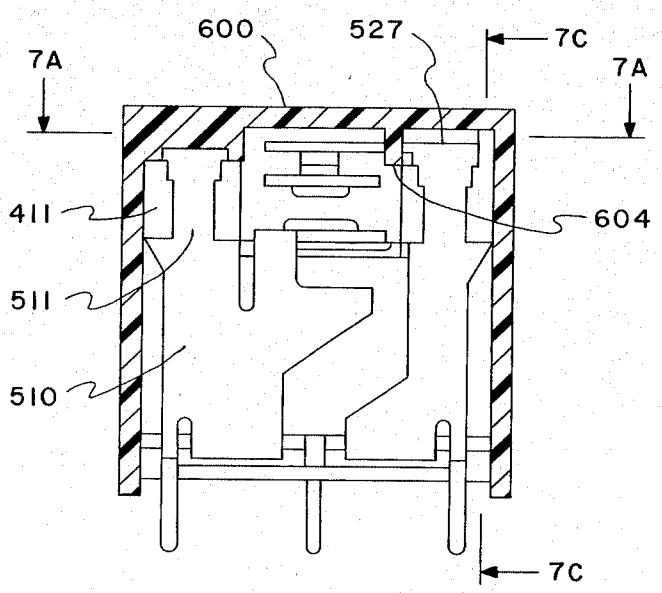
FIGS. 7A, 7B and 7C are top, front and side cross sectional views of the embodiment of FIG. 5 respectively.
Figure 7A:
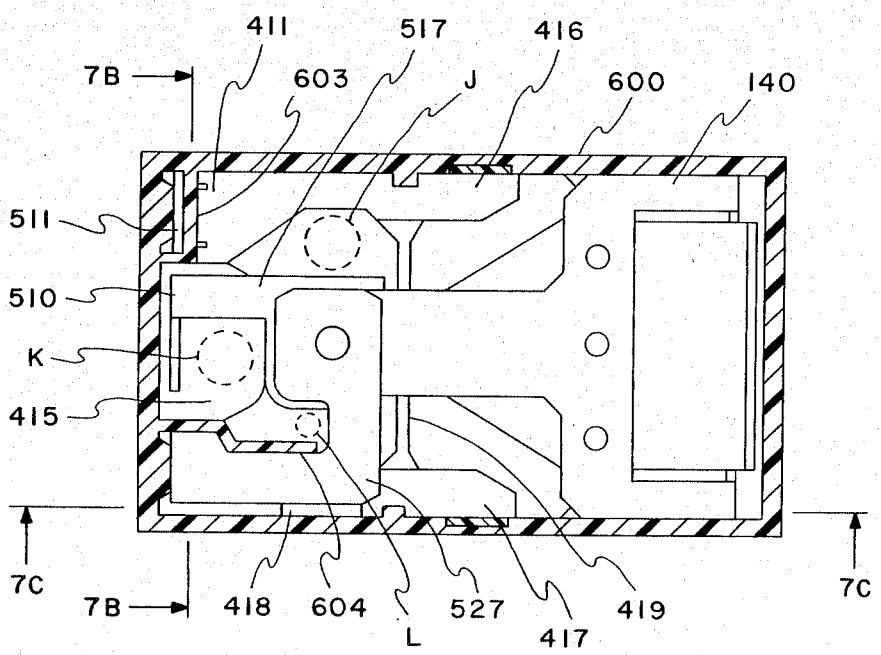
Figure 7C:
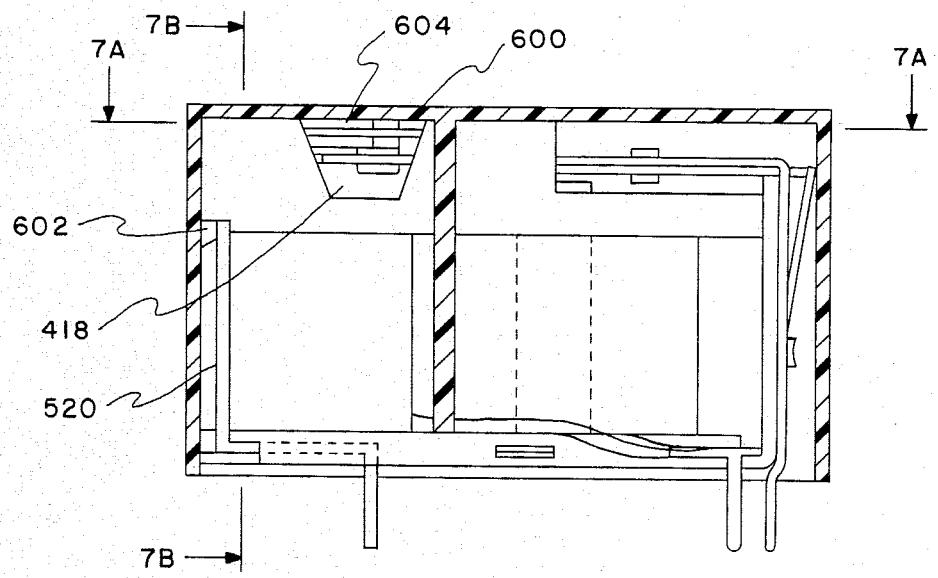

Referring to FIGS. 7A, 7B and 7C, the base member 400 is assembled with the contact members 510 and 520 and other elements, and then is covered with the cover 600. The partition wall 603 covers part of the contact member 510 which is projecting above the gripping portion 411 to prevent a deposition of particles vaporized from the contacts. Similarly, the partition wall 604 covers the arm portion 527 to prevent a deposition of vaporized particles.

Referring particularly to FIG. 7A, on a portion J, electric short-circuits seldom occur as a result of a deposition of vaporized particles because the space between the side wall portion 416 and the contact members 510 or 140 is large. Vaporized particles are hardly deposited on a portion K, since the space is the notch 415 of the upper base 410. Even if a small amount of particles is deposited on the cover 600, an electric short-circuit rarely occurs, because the arm portions 517 and 527 extend over a substantial distance between the contacts 515 and 525 and the cover 600. The distance between the wall portion L also limits possible short-circuiting which might otherwise be caused by deposited vaporized particles. The presence of the partition wall 419 between the core 110 and the contact 515 also helps to avoid electrical short-circuits.

The notch 418 is provided in the wall portion 417 to create a distance for vaporized particles between the contact members 510 and 140, to inspect the state of the contacts before the cover 600 is placed, and to facilitate a holding of the arm portion 527 with a pair of cutting pliers. The pliers changes the bending angle of the portion 527, when the dielectric strength on the contact 525 is adjusted by changing the distance between contacts.

As has been described above, the second embodiment is further improved to avoid an electrical short-circuiting which may be caused by the deposition of particles which are vaporized from the contact in a large current switching circuit. Therefore, the insulation of this EM relay does not easily deteriorate, despite an extreme increase in the number of relay operations. This results in a longer durable life.

Figure 8:
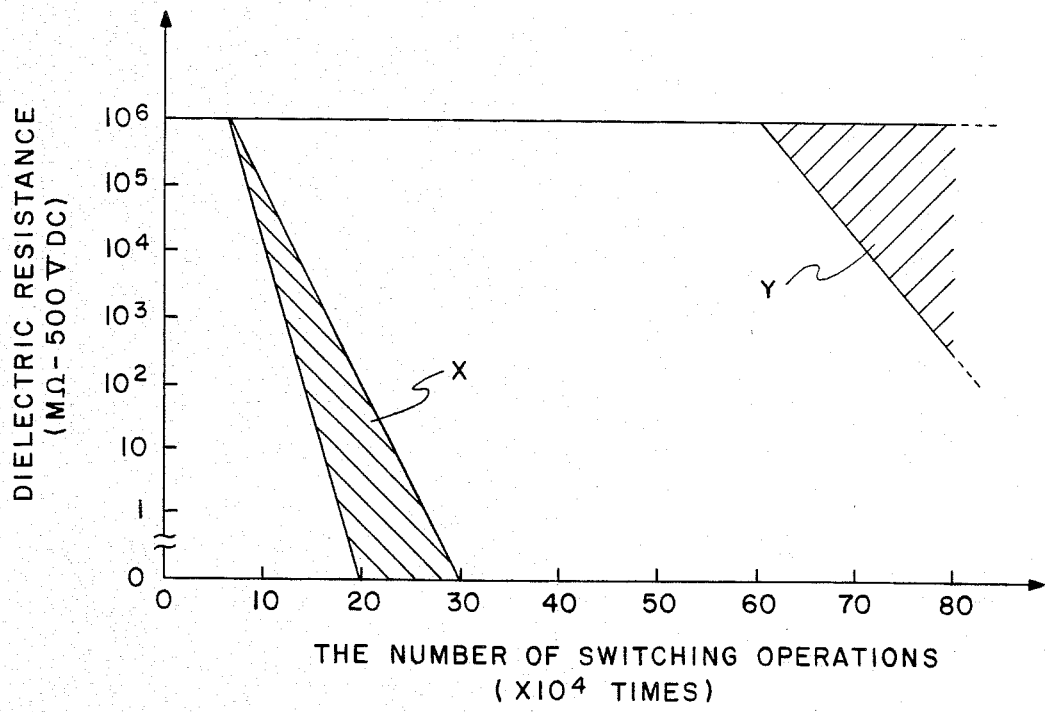
FIG. 8 is a characteristic graph for describing the relationship between the number of switching operations and dielectric resistance in the prior art relay and the first and second embodiment of this invention.

FIG. 8 shows the relationship between the number of switching operations [$\times 10^4$ times] and of dielectric resistance [megaohms] at the application of 500 volts DC (direct current) in the prior art EM relay described in the U.S. Pat. No. 4,535,311 and in the first and second embodiments. A region indicated by English letter X indicates that the relays of the prior art and of the first embodiment (FIG. 1) have values lying in that region. A region indicated by English letter Y indicates that the relay of the second embodiment (FIG. 5) has values lying in that region. It is obvious that the relay of the second embodiment causes less insulative deterioration than the prior art relay or the relay of the first embodiment.

Although the gripping portions 211, 212 (FIG. 1), 411 and 412 (FIG. 6A) are provided on the upper side of the upper bases 210 and 410, in the above description, they may, be provided on the lower side thereof. The projections 2113 and 2123 (FIG. 2) are provided on the side wall potions 2114 and 2124, respectively and may also be provided a plurality of pairs in an arbitrary form. The grooves 221, 222 (FIG. 2), 421 and 422 (FIG. 6A) of the lower bases 220 and 420 may be formed to have both ends either open or closed.

A plurality of the projections 318 and 328 (FIGS. 3A, 3B) on the inserting portion 313 and 323 may be provided for facilitating engagement of the grooves 221 and 222 with the portions 313 and 323. The inserting portions 313 and 323 may also have projections on the upper side thereof.

The terminals 316, 326 (FIGS. 3A, 3B), 516 and 526 (FIG. 6A) extend from the center portions 314, 324, 514 and 524. They may also extend directly from the inserting portions 313, 323, 513 and 523. The grooves 2211, 2221 (FIG. 2), 4211 and 4221 (FIG. 6A) may extend to the side faces of the lower bases 220 and 420.

The materials used for the structural elements are not limited to those described in the foregoing, but may be anything so long as they satisfy the necessary conditions.

What is claimed is:

1. An electromagnetic relay comprising:

a first stationary contact member made of electrically conductive material and including a center portion with a wide plate region, a gripped portion extending above said center portion, a stationary contact portion which extends in a substantially perpendicular direction from the upper end of said center portion and which has a first stationary electrical contact thereon, an inserting portion extending in the substantially perpendicular direction from the lower end of said center portion, and an L-shaped terminal extending in the substantially perpendicular direction from the lower end of said center portion;

a second stationary contact member made of electrically conductive material and including a center portion, a gripped portion extending above said center portion, a stationary contact portion which extends in the substantially perpendicular direction from the upper end of said gripped portion and which has a second stationary electrical contract thereon, an inserting portion extending in the substantially perpendicular direction from the lower end of said center portion, and an L-shaped terminal extending in the substantially perpendicular direction from the lower end of said center portion;

an insulative base member which includes a hollow tube portion having a core therein and having a coil wound on said tube, a first base on one end of said tube portion and having first and second gripping portions for securing said gripped portions of said first and second stationary contact members respectively, said first base of said base member further comprises a first and second side wall portions extending from said first and second gripping portions, respectively, a partition wall for connecting these side wall portions to each other and for separating one end of said core from said first stationary contact, and a second base on the other end of said tube portion, said first and second bases being substantially parallel to each other, said second base having first and second grooves for receiving and securing said inserting portions of said first and second stationary contact members respectively and having first and second guide grooves for receiving and guiding said terminals of said first and second stationary contact members respectively;

a yoke which is magnetically connected at one end thereof to one end of said core mounted on said base;

an armature magnetically connected at one end thereof to the other end of said yoke, said armature being mounted to move toward or away from the other end of said core; and a movable contact member made of mechanically flexible and electrically conductive material having a movable arm portion including a movable electrical contact, said movable contact being positioned between said first and second stationary contacts to selectively contact either said first or said second stationary contact in response to the movement of said armature moving toward or away from said other end of said core.

2. An electromagnetic relay comprising:

a first stationary contact member made of electrically conductive material and including a center portion with a wide plate region, a gripped portion extending above said center portion, a stationary contact portion which extends in a substantially perpendicular direction from the upper end of said center portion and which has a first stationary electrical contact thereon, an inserting portion extending in the substantially perpendicular direction from the lower end of said center portion, and an L-shaped terminal extending in the substantially perpendicular direction from the lower end of said center portion, said first stationary contact member further including an elongated arm portion between said center portion and said stationary contact portion;

a second stationary contact member made of electrically conductive material and including a center portion, a gripped portion extending above said center portion, a stationary contact portion which extends in the substantially perpendicular direction from the upper end of said gripped portion and which has a second stationary electrical contract thereon, an inserting portion extending in the substantially perpendicular direction from the lower end of said center portion, and an L-shaped terminal extending in the substantially perpendicular direction from the lower end of said center portion, said second stationary contact member further including an elongated arm portion between said gripped portion and said stationary contact portion;

an insulative base member which includes a hollow tube portion having a core therein and having a coil wound on said tube, a first base on one end of said tube portion and having first and second gripping portions for securing said gripped portions of said first and second stationary contact members respectively, and a second base on the other end of said tube portion, said first and second bases being substantially parallel to each other, said second base having first and second grooves for receiving and securing said inserting portions of said first and second stationary contact members respectively and having first and second guide grooves for receiving and guiding said terminals of said first and second stationary contact members respectively;

a yoke which is magnetically connected at one end thereof to one end of said core mounted on said base;

an armature magnetically connected at one end thereof to the other end of said yoke, said armature being mounted to move toward or away from the other end of said core; and a movable contact member made of mechanically flexible and electrically conductive material and having a movable arm portion including a movable electrical contact, said movable contact being positioned between said first and second stationary contacts to selectively contact either said first or said second stationary contact in response to the movement of said armature moving toward or away from said other end of said core.

3. A miniature relay comprising at least one pair of electrical contacts mounted on leaf springs for controlling current, said contacts being made of a material which erodes when said current is high whereby particles of contact material may be spread in the area of said contacts responsive to arc discharges which occur as said contacts operate, insulating base means with a spaced parallel pair of plates for supporting said leaf springs carrying said contacts, a contact operating winding located between said parallel plates, a yoke which is magnetically coupled into an electromagnetic field generated by an energization of said contact operating winding, an armature associated with said yoke, a flexible leaf spring coupled to said armature for opening and closing said contacts responsive to an energization or deenergization of said winding, said base and leaf springs being shaped to provide a substantially increased distance between surfaces on which said particles of contacts material may be deposited thereby reducing the chances of a short circuit, means including said insulating base for supporting said leaf springs in a mutually perpendicular orientation, two of said leaf springs, each of said leaf springs including a gripped portion, means on opposite sides of said base for separately and individually gripping and supporting said gripped portions to hold said two leaf springs in said mutually perpendicular orientations, bent portions on each of said two leaf springs, said bent portions approaching each other in mutually perpendicular directions with an overlapping area at the ends of said bent portions, upper and lower ones of said contacts being supported by individually associated ones of said bent portions in said overlapping areas, one of said leaf springs having a tip end positioned between said bent portions and within said overlapping area, said one leaf spring extending away from said overlap area in a direction which does not overlap other parts of said bent portions, and contact means on said tip end for moving between said upper and lower contacts responsive to said energization and deenergization of said contact operating winding.

4. An electromagnetic relay as claimed in claim 2 wherein said first base of the base member further comprises first and second side wall portions extending from said first and second gripping portions, respectively, and a partition wall for connecting the side wall portions to each other and for separating one end of said core from said first stationary contact.

5. An electromagnetic relay as claimed in claim 4 wherein said base member further includes a notch at a position adjacent to said first stationary contact of said second side wall portion in order to provide a substantial clearance space around said first stationary contact.

6. An electromagnetic relay as claimed in claim 2 wherein said first base further includes a U-shaped notch at a position between said first and second gripping portions.

7. An electromagnetic relay as claimed in claim 6 wherein said first base of said base member further comprises first and second side wall portions extending from said first and second gripping portions, respectively, and a partition wall for connecting the side wall portions to each other and for separating one end of said core from said first stationary contact.

8. An electromagnetic relay as claimed in claim 7 further comprising:

a cover made of an insulative material and having a first partition wall for covering said arm portion of said second stationary contact member when said cover is mounted on said base member.

9. A electromagnetic relay as claimed in claim 8 wherein said cover further includes a second partition wall to cover the upper end of said first stationary contact member when said cover is mounted on said base member.

10. The relay of claim 3 and sidewalls and partition walls on said base for separating said leaf springs and said contact operating winding from each other to prevent the build up of a short circuiting deposit of said particles responsive to said erosion of said contacts.

11. The relay of claim 10 and at least one notch formed in said insulating base for providing a clearance space around said contacts.

* * * * *